US010203110B2

(12) United States Patent
Medawar

(10) Patent No.: US 10,203,110 B2
(45) Date of Patent: Feb. 12, 2019

(54) CANDLE WITH EMBEDDED OBJECT

(71) Applicant: Ronny Medawar, Linden, MI (US)

(72) Inventor: Ronny Medawar, Linden, MI (US)

( * ) Notice: Subject to any disclaimer, the term of this patent is extended or adjusted under 35 U.S.C. 154(b) by 75 days.

(21) Appl. No.: 15/419,387

(22) Filed: Jan. 30, 2017

(65) Prior Publication Data

US 2017/0234530 A1 Aug. 17, 2017

Related U.S. Application Data

(60) Provisional application No. 62/287,989, filed on Jan. 28, 2016.

(51) Int. Cl.
*F23D 3/16* (2006.01)

(52) U.S. Cl.
CPC ..... *F23D 3/16* (2013.01)

(58) Field of Classification Search
USPC ..... 431/291, 320
See application file for complete search history.

(56) References Cited

U.S. PATENT DOCUMENTS 1,259,921 A * 3/1918 Squeglia ..... F21V 35/00 431/291
1,299,977 A * 4/1919 McGuire ..... F23D 3/24 431/291
1,367,921 A * 2/1921 Pomije ..... F21V 37/00 431/291
5,390,443 A * 2/1995 Emalfarb ..... A47G 7/044 211/119
6,896,511 B2 5/2005 Chadha
8,899,973 B2 12/2014 Cayton
2013/0209945 A1* 8/2013 Cayton ..... B29C 39/10 431/289
2013/0209949 A1 8/2013 George
2016/0040097 A1* 2/2016 Cayton ..... C11C 5/02 431/289

* cited by examiner

*Primary Examiner* — Avinash Savani
(74) *Attorney, Agent, or Firm* — The Weintraub Group, P.L.C.

(57) ABSTRACT

The present invention provides a candle holder assembly for removably embedding an object within a candle. The candle holder assembly includes a container and a candle disposed therein. The candle holder assembly further includes a support having an inverted U-shaped hook and a saddle. The hook includes a first stem, a second stem, and a bight portion interconnecting the first stem and the second stem. The first stem and the second stem each extend downwardly from opposite ends of the bight portion which is removably seated on the rim of the container. The saddle includes a pair of diverging rear legs extending downwardly from an end of the second stem opposite the bight portion, a pair of elements extending outwardly from respective ends of the pair of rear legs opposite the second stem, and a pair of forward legs extending upwardly from respective ends of the pair of elements opposite the pair of rear legs. A case, which removably stores an object, is removably seated within the saddle of the support.

17 Claims, 4 Drawing Sheets

CANDLE WITH EMBEDDED OBJECT

CROSS-REFERENCE TO RELATED APPLICATION

This application is a completion application which claims the priority benefit of U.S. Provisional Patent Application Ser. No. 62/287,989, filed Jan. 28, 2016, for "Support For Embedded Item," the entire disclosure of which, including the drawing, is hereby incorporated by reference.

BACKGROUND OF THE INVENTION

1. Field of the Invention

The present invention pertains to a candle holder assembly for suspending an object within a candle holder or container. More particularly, the present invention concerns a candle holder assembly for removably embedding an object within a candle disposed within a candle holder. Even more particularly, the present invention concerns a support removably seated on a container for suspending an object therein.

2. Description of Related Art

It is common practice for people to give and receive gifts. In some cultures, it is customary to wrap a gift in an attractive package which is pleasing to the eye of the recipient and which also prevents the recipient from immediately ascertaining the nature and/or value of the gift. By doing so, this peaks the interest of the recipient, increases the recipient's anticipation of the unwrapping of the gift, and increases the recipient's delight and enjoyment when the gift is finally revealed.

Scented candles are popularly chosen as gifts due to their pleasant scent. A burning candle provides a warm, relaxing atmosphere, and may be associated with love, romance, or special occasions. The body of a candle may be fabricated from an opaque or translucent material, such as wax, which is consumed as the candle burns. Therefore, candle bodies make an ideal container within which to removably embed or temporarily conceal an item, such as a piece of jewelry or other objects, where the presence, nature, and/or value of the item is intended to be slowly revealed as the candle burns, to the delight of the recipient of the candle.

In addition, the anticipation one feels while waiting to find out the nature or value of a gift received is heightened when the recipient of a candle knows that the value of an item embedded therein may be larger, and sometimes much larger, than the value of the candle itself.

Heretofore, the prior art has taught candles with an embedded item. For example, U.S. Pat. No. 8,899,973 to Cayton teaches an object being added to a candle and concealed therein. The object intended to be embedded in the candle is initially placed in a pouch for safekeeping. The pouch is then adhered with an adhesive to an inside wall of a candle holder. Finally, wax is poured into the candle holder to submerge the pouch. The pouch remains concealed until the candle is lit. When the candle is consumed to a point below the pouch, the object or the pouch, itself, may be removed from the candle holder. Cayton also teaches that the object may be embedded in the candle without being adhered to the wall of the candle holder. Here, Cayton teaches pouring a first portion of wax into the candle holder.

Then, when the wax solidifies, the pouch is positioned thereon. Thereafter, additional wax is poured over the pouch to a desired height.

U.S. Patent Application Publication No. 2013/0209946 to George et al. teaches multiple, therapeutic gemstones embedded within a candle during the candle manufacturing. As the candle burns, the gemstones are gradually exposed. A variety of therapeutic qualities are exhibited by the candle based on the combination of gemstones and candle scents chosen. These therapeutic qualities can, in theory, range from relieving stress using the amethyst gemstone to encouraging prosperity and wealth with the citrine gemstone.

Another example of a candle having an object embedded therein is taught in U.S. Pat. No. 6,896,511 to Chadha. According to Chadha, an object is inserted into a candle after the wax solidifies. The object embedded in the candle is a free-floating object which is inserted into the candle by making an incision in the wax or separating the wax from an edge of the candle holder. The object is then inserted into the incision and the surrounding wax is re-melted to fully submerge the object. Once the candle is lit and the wax burns to a point at which the object is at least partially accessible, the object may then be retrieved.

It is to be appreciated that while the prior art demonstrates objects being embedded within a candle, none teach the object being removably suspended in a candle holder in a nondestructive manner, only temporarily affixed thereto.

SUMMARY OF THE INVENTION

The present invention provides, in a first aspect, a candle holder assembly for removably embedding or temporarily concealing an object, such as a jewelry item, within a wax candle and which can be removed once the candle at least partially melts. The candle holder assembly, generally, comprises:

(a) a container, the container including a bottom wall and a side wall, the container having an exterior surface and an interior surface, the side wall extending upwardly from the bottom wall and terminating at a rim;

(b) a wax candle disposed within the container;

(c) an integrally formed support removably seated on the rim of the container for removably seating an object within the candle, the support comprising: (i) an inverted U-shaped hook; (ii) a saddle; and (d) an openable case for removably storing an object, the case being removably supported within the saddle.

The inverted U-shaped hook of the support includes: (a) a first stem; (b) an opposed second stem; and (c) a bight portion interconnecting the first stem and the second stem. The first stem extends downwardly from an end of the bight portion along the exterior surface of the container when positioned thereon. The second stem extends downwardly from an end of the bight portion opposite the first stem along the interior surface of the container when positioned thereon.

Furthermore, the saddle includes: (a) a pair of diverging rear legs extending downwardly from a free end of the second stem; (b) a pair of elements extending from respective ends of the pair of rear legs, the pair of elements extending toward a center of the container; and (c) a pair of forward legs extending upwardly from respective free ends of the pair of elements.

Preferably, the case comprises two separable half shells that allow an object to be removably stored therein. The object may then be recovered once the candle is lit and the wax at least partially melts, thereby exposing the case.

The support itself, in a second aspect hereof, exhibits utility apart and aside from its use in connection with the candle holder.

For a more complete understanding of the present invention, references are made to the following detailed description and accompanying drawing. In the drawing, like reference characters refer to like parts throughout the several views in which:

DETAILED DESCRIPTION OF THE INVENTION

Figure 1:
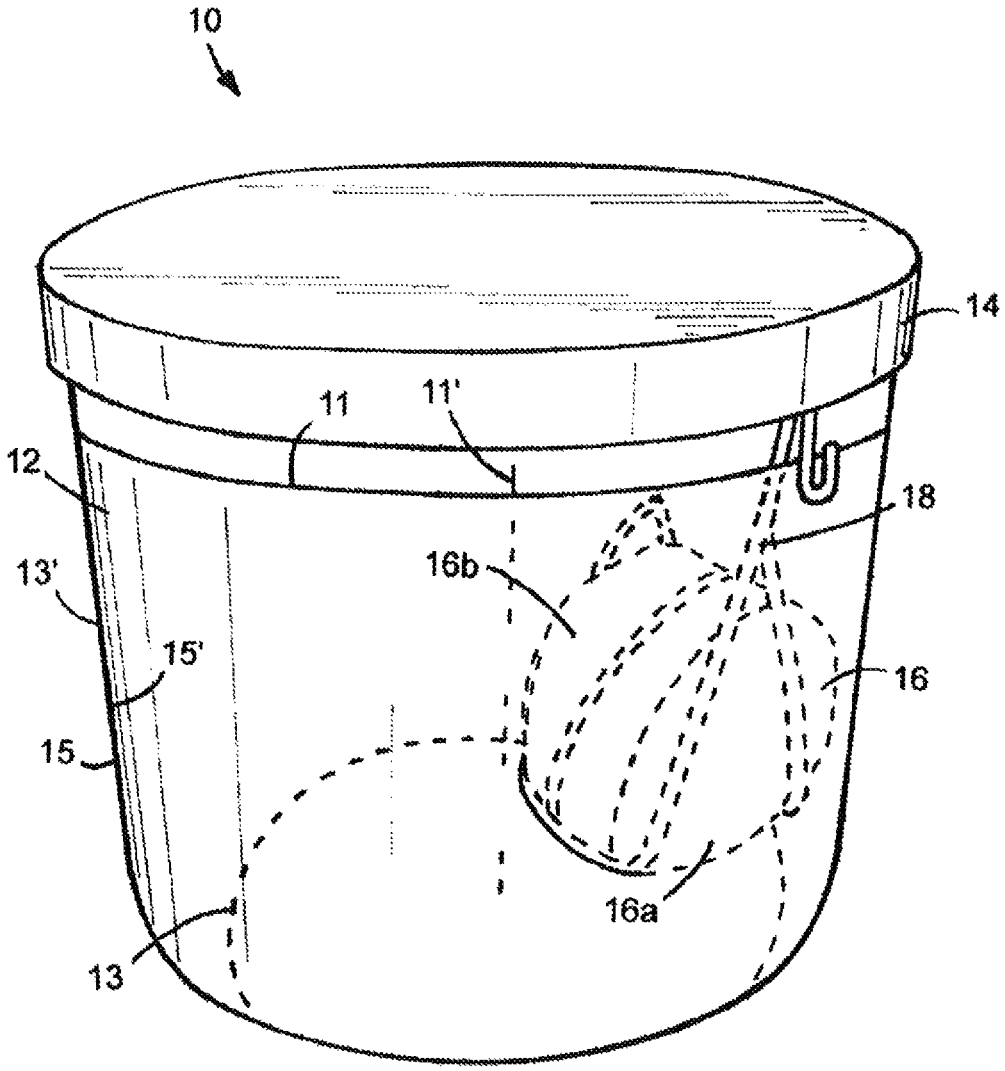
FIG. 1 is a perspective view of a candle holder assembly in accordance with the present invention.
Figure 2:
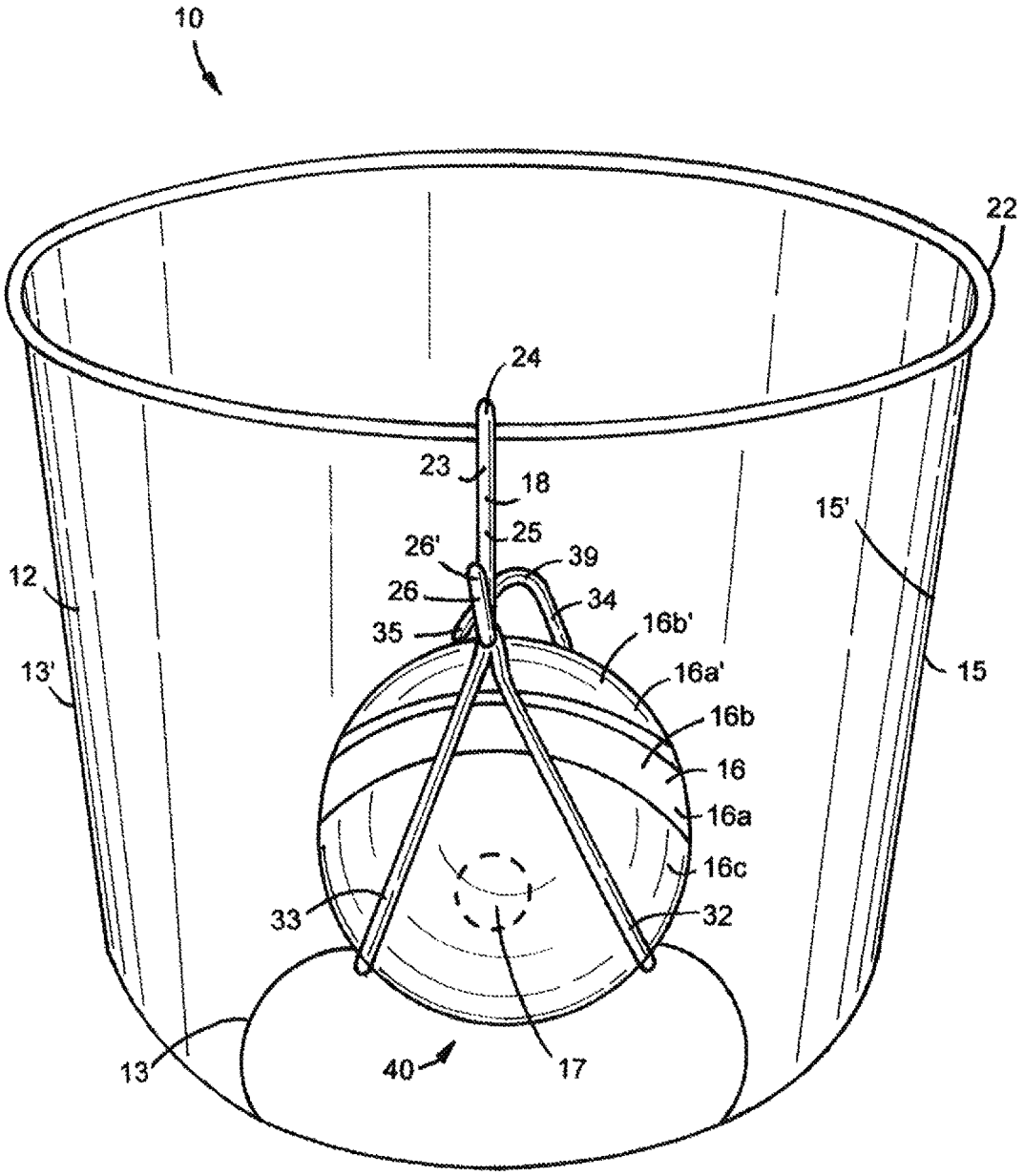
FIG. 2 is a rear view of the candle holder assembly hereof.
Figure 3:
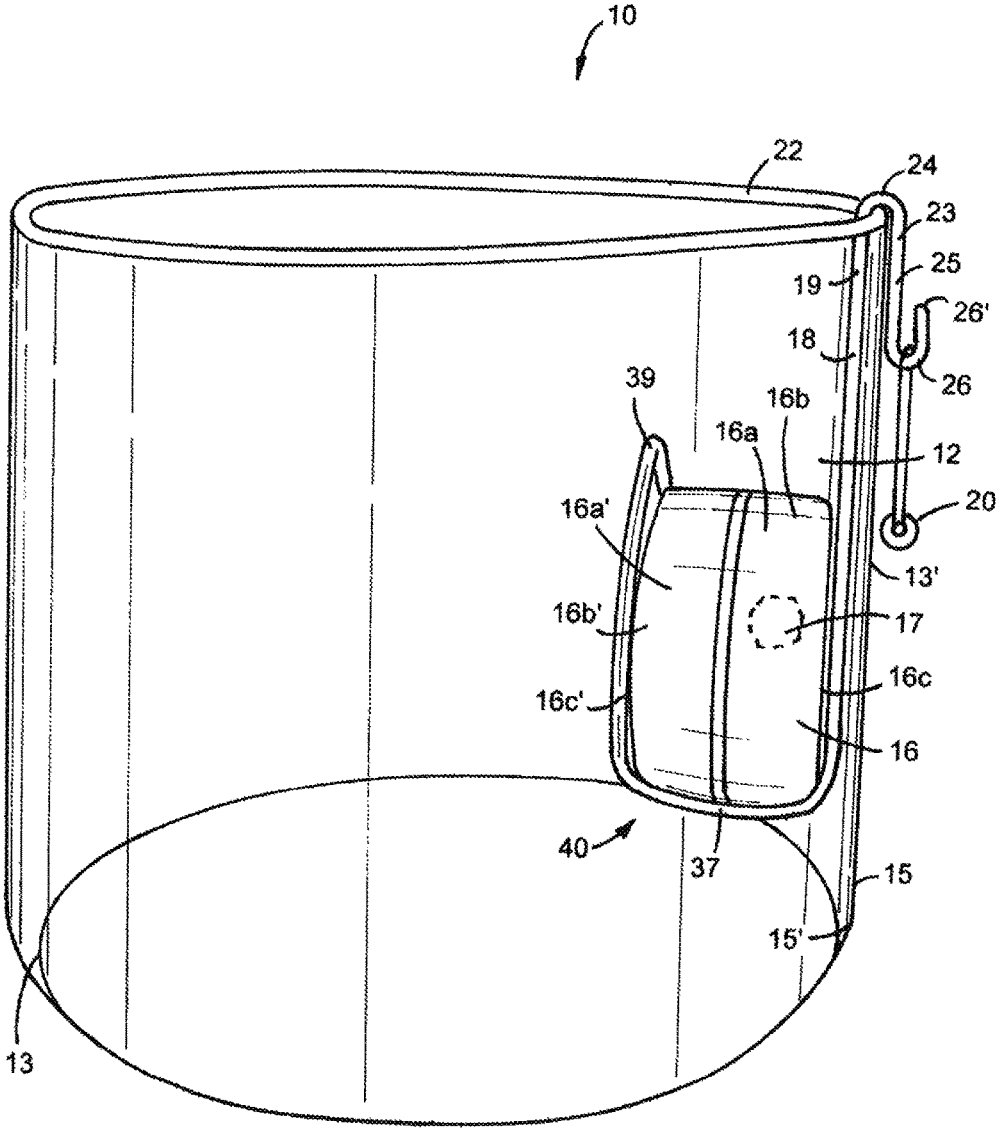
FIG. 3 is a side view of the candle holder assembly hereof.
Figure 4:
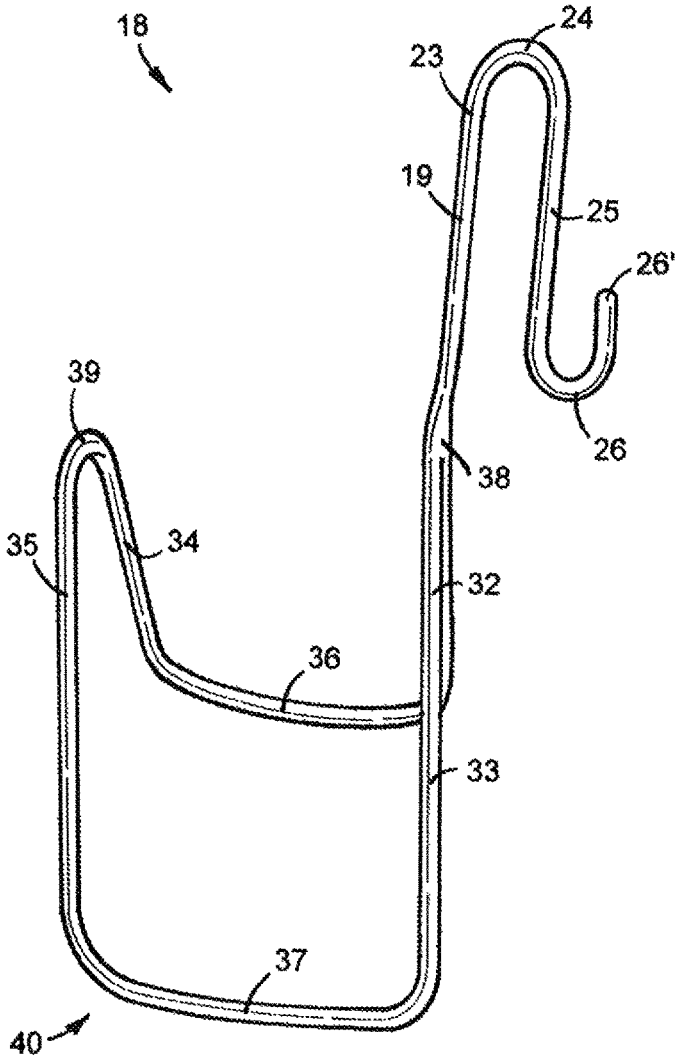
FIG. 4 is a side view of a support used in accordance with the present invention.

Now, and with reference to FIGS. 1-4 of the drawing in a first aspect hereof, the present invention provides a candle holder assembly, generally, denoted at 10 for removably embedding an object in a candle.

With more particularity, the candle holder assembly 10, generally, comprises: (a) a candle holder or container 12; (b) a candle 11 having a wick 11', the candle 11 being disposed within the container 12; (c) a support 18 for removably embedding an object 17 within the candle 11; and (d) an openable case 16 for removably storing an object 17 therein.

More specifically, the container 12, such as a glass jar or the like, is an open-top container including a bottom wall 13 and a side wall 13'. The side wall 13' is shown herein as a cylindrical wall, but it is to be understood that the container 12 can have other configurations.

As shown, the container 12 has an exterior surface 15 and an interior surface 15'. The side wall 13' extends upwardly from the bottom wall 13 and terminates at a rim 22. Optionally, a lid 14 may be removably seated on the rim 22 to prevent any foreign objects from entering the container 12 prior to use.

As noted above, the candle 11 is disposed within the container 12. The candle 11 is formed from any suitable wax and includes a wick 11' for lighting the candle 11.

The candle holder assembly 10 further comprises a support 18 for removably suspending a case 16, as described below, which contains the object 17 therein and is to be embedded within the wax of the candle 11.

The support 18, when positioned, is removably seated on the rim 22 of the container 12. Preferably, the support 18 is an integrally formed or unitary structure comprising an inverted U-shaped hook 23 and a saddle 40.

The hook 23 includes a first stem or leg 25, an opposed second stem or leg 19, and a bight portion 24 interconnecting the first stem 25 and the second stem 19.

The first stem 25 of the hook 23 extends downwardly from a first end of the bight portion 24 and along the exterior surface 15 of the container 12. Optionally, the first stem 25 may include an upturned leg 26 extending from the free end of the first stem 25. The upturned leg 26 forms a U-shaped hook terminating at an end 26'.

A secondary object 20, such as a tag, label, tassel, or other decorative object, may be suspended on the upturned leg 26 exteriorly of the container 12.

While the upturned leg 26 is depicted as a U-shaped hook, the end 26' of the upturned leg 26 may be twisted around a portion of the first stem 25, thus connecting the end 26' of the upturned leg 26 to the first stem 25 to form a completed loop. Such twisting of the upturned leg 26 may be possible if the upturned leg 26 is formed of a pliable material such as a metallic wire made of copper, tin, aluminum, or the like.

Alternatively, if it is desired that the upturned leg 26 include a completed loop structure, the end 26' of the upturned leg 26 or the upturned leg 26, itself, may comprise a circular loop formed therein.

As shown in the drawing, the bight portion 24 engages the rim 22 of the container 12 for removably seating the support 18 thereon.

The second stem 19 extends downwardly from the second end of the bight portion 24 and along the interior surface 15' of the container 12. The second stem 19 terminates at a diverging point 38.

Preferably, the first stem 25 has a first length and the second stem 19 has a second length longer than the first length of the first stem 25. However, this is not critical to the present invention. Thus, the lengths of the stems 25, 19 may be equal or the first length of the first stem 25 may be longer than the second length.

As noted above, the support 18 further comprises a saddle 40 integrally formed with the hook 23 for removably seating an object 17 thereon. The saddle 40 includes pair of diverging rear legs 32, 33, a pair of elements 36, 37, and a pair of forward legs 34, 35.

The pair of rear legs extend downwardly from the diverging point 38, thereby creating an inverted Y-shaped structure.

The pair of elements 36, 37 project outwardly from the rear legs 32, 33, respectively, and toward a center of the container 12 in a first direction away from the first stem 25. Preferably, the elements 36, 37 are substantially co-planar, parallel, and spaced apart from one another.

The pair of forward legs 34, 35 extend upwardly from a respective end of the elements 36, 37. Preferably, the forward legs 34, 35 are substantially perpendicular to the pair of elements 36, 37 and parallel to the rear legs 32, 33. Additionally, the forward legs 34, 35 may converge in an arch or bight portion 39 interconnecting the forward legs 34, 35.

Each of the legs 32, 33, 34, 35 and the elements 36, 37 cooperate with one another to define the saddle 40 upon which the case 16 or the object 17 may be removably seated.

It is to be understood that the geometry of the saddle 40 may vary based on the angulation and lengths of the legs 32, 33, 34, 35 and the elements 36, 37 without deviating from the scope of the present invention. Furthermore, the pair of elements 36, 36 may be merely extensions of the legs 32, 33, 34, 35 themselves.

Preferably, the support 18 is fabricated from a durable metal, such as steel, nickel, iron, titanium, or the like, such that the support 18 can resist the heat generated by the burning candle 11 without becoming damaged.

As noted above, the candle holder assembly 10 further comprises a case 16 for removably storing an object 17 therein. The case 16 may have a variety of geometries, but is dimensioned to fit securely within the saddle 40. Preferably, the case 16 comprises two shell pieces **16*a*, 16*a'* which cooperate and interconnect with one another to form a hollow casing for removably storing the object 17 therein. Each shell piece 16*a*, 16*a'*, preferably, comprises a bottom wall 16***c*, 16*c*' and a side wall 16*b*, 16*b*', respectively. The side walls 16*b*, 16*b*' extend outwardly from respective bottom walls 16*c*, 16*c*'.

The shell pieces 16*a*, 16*a*' are removably secured to one another in any suitable manner. One shell piece may have a slightly smaller diameter than the other shell piece such that the shells 16*a*, 16*a*' frictionally mate or interconnect. Alternatively, the shell pieces 16*a*, 16*a*' may be threadably interconnected and screwed together.

The case 16 is fabricated from any suitable, durable material, such as tin, aluminum, or the like, able to withstand being encased in wax for a long period of time and able to endure the heat from the burning candle 11, thereby protecting the object 17 stored therein.

The case 16 not only serves to protect the object 17 from any damage caused by being encased in melting wax, but also serves to conceal the object 17 from the recipient until it is removed from the container 12.

Preferably, the object 17 is a piece of jewelry, but it is understood that any variety of valuable or novelty items may be emplaced within the case 16.

In practicing the present invention and in seating the object 17 in the container 12, the support 18 is seated on the rim 22 of the container 12. The case 16, which contains the object 17, is seated within the saddle 40 of the support 18. Wax is then poured into the container 12 until the case 16 is fully submerged. Subsequently, the optional lid 14 may be placed atop the rim 22 of the container 12, if desired.

Thereafter, a recipient may light the wick 11' of the candle 11 until the case 16 or the object 17 is at least partially exposed or the wax has sufficiently melted to enable the recipient to remove the case 16 from the container 12 and reveal the object 17 stored therein.

In a second aspect hereof, it is to be appreciated that the support 18 hereof exhibits utility apart and aside from its association with the candle holder hereof. Thus, it can be used in other environments where it is desired to removably suspend an object within a container.

From the above, it is to be appreciated that defined herein is a new and unique candle holder assembly for removably embedding an object within a candle.

LIST OF REFERENCE NUMERALS

10 Candle holder assembly
11 Candle
11' Wick of candle
12 Container
13 Bottom wall
13' Side wall
14 Lid
15 Exterior surface of the container
15' Interior surface of the container
16 Case
16*a* First half
16*b* Side wall of first half
16*c* Bottom wall of first half
16*a*' Second half
16*b*' Side wall of second half
16*c*' Bottom wall of second half
17 Object
18 Support
19 Second stem
20 Secondary object
22 Rim
23 U-shaped hook
24 Bight portion
25 First stem
26 Upturned leg
26' End of upturned leg
32 Rear leg
33 Rear leg
34 Forward leg
35 Forward leg
36 Element
37 Element
38 Diverging point
39 Arch
40 Saddle

Having thus described the invention, what is claimed is:

1. A candle holder assembly for removably embedding an object within a candle, the apparatus comprising:

(a) a container, the container including a bottom wall and a side wall, the container having an exterior surface and an interior surface, the side wall extending upwardly from the bottom wall and terminating at a rim;

(b) a wax candle disposed within the container;

(c) an integrally formed support being removably seated on the rim of the container for removably seating an object within the candle, the support comprising:

(i) an inverted U-shaped hook including:

(1) a first stem;

(2) an opposed second stem;

(3) a bight portion interconnecting the first stem and the second stem, the first stem and the second stem each extending downwardly from opposite ends of the bight portion along the exterior surface and the interior surface of the container, respectively, an upturned leg extending upwardly from an end of the first stem opposite the bight portion;

(ii) a saddle including:

(1) a pair of diverging rear legs extending downwardly from a free end of the second stem;

(2) a pair of elements extending outwardly from respective ends of the pair of rear legs, the pair of elements extending toward a center of the container;

(3) a pair of forward legs extending upwardly from respective ends of the pair of elements opposite the pair of rear legs;

(d) an openable case for removably storing an object therein, the case being disposed atop the pair of elements.

2. The assembly of claim 1 wherein the upturned leg is a circular loop.

3. The assembly of claim 1 wherein the upturned leg is twisted around a portion of the first stem to form a completed loop.

4. The assembly of claim 1 wherein the pair of forward legs converge at a point opposite the pair of elements to form an arc interconnecting the pair of forward legs.

5. The assembly of claim 1 wherein the case includes a pair of separable half shells.

6. The assembly of claim 5 wherein the half shells of the case are threadably secured to one another.

7. The assembly of claim 5 wherein the half shells of the case are frictionally secured to one another.

8. The assembly of claim 1 wherein the object is a jewelry item.

9. An integrally formed support for suspending an object, the support comprising:

(a) an inverted U-shaped hook, the hook including:

(i) a first stem;

(ii) a second stem;

(iii) a bight portion interconnecting the first stem and the second stem, the first stem and the second stem each extending downwardly from opposite ends of the bight portion, an upturned leg extending upwardly from an end of the first stem opposite the bight portion; and (b) a saddle for supporting an object thereon, the saddle including:

(i) a pair of diverging rear legs extending downwardly from a free end of the second stem;

(ii) a pair of elements extending in a first direction outwardly from respective ends of the pair of rear legs;

(iii) a pair of forward legs extending upwardly from respective ends of the pair of elements opposite the pair of rear legs.

10. The support of claim 9 wherein the upturned leg is a circular loop.

11. The support of claim 9 wherein the upturned leg is twisted around a portion of the first stem to form a completed loop.

12. The support of claim 9 wherein the pair of forward legs converge at a point opposite the pair of elements to form an arc interconnecting the pair of forward legs.

13. The support of claim 9 further comprising:

an openable case for removably storing an object therein, the case being removably disposed atop the pair of elements and within the saddle.

14. The support of claim 13 wherein the case includes a pair of separable half shells.

15. The support of claim 14 wherein the half shells of the case are threadably secured to one another.

16. The support of claim 14 wherein the half shells of the case are frictionally secured to one another.

17. The support of claim 13 wherein the object is a piece of jewelry.

* * * * *